US006129561A

United States Patent [19]

Lok

[11] Patent Number: 6,129,561

[45] Date of Patent: Oct. 10, 2000

[54] PLUG CONNECTOR SECURING A PRINTED CIRCUIT BOARD MOUNTED WITH CONTACTS THEREON

[75] Inventor: Gordon Lok, Montebello, Calif.

[73] Assignee: Hon Hai Precision Ind. Co., Ltd., Taipei Hsien, Taiwan

[21] Appl. No.: 09/222,439

[22] Filed: Dec. 28, 1998

[51] Int. Cl.[7] ..... H01R 12/00

[52] U.S. Cl. ..... 439/76.1; 439/903

[58] Field of Search ..... 439/76.1, 892, 439/55, 64, 344, 629, 676, 903

[56] References Cited

U.S. PATENT DOCUMENTS 5,830,005 11/1998 Watanabe ..... 439/418

5,989,069 11/1999 Tan ..... 439/620

*Primary Examiner*—Neil Abrams
*Assistant Examiner*—Michael C. Zarroli
*Attorney, Agent, or Firm*—Wei Te Chung

[57] ABSTRACT

An electrical connector comprises a plug, a printed circuit board, and a contact unit mounted on the printed circuit board and comprising a plurality of contacts with an insulative housing formed therearound. The PCB together with the contact unit is slidably received in a slot defined in the plug wherein a snap lock device securely retains the PCB in the plug. A plurality of contact receiving passageways are defined in the plug each having a lip protruding therein from a rear end of the plug. Each lip engages with a tail end of the corresponding contact thereby preventing inadvertent deformation of the contact during assembly with a mating receptacle connector.

15 Claims, 3 Drawing Sheets

PLUG CONNECTOR SECURING A PRINTED CIRCUIT BOARD MOUNTED WITH CONTACTS THEREON

BACKGROUND OF THE INVENTION

1. Field of The Invention

The present invention relates to an electrical connector, and particularly to a fibre channel connector which slidably receives and releasably secures a printed circuit board therein.

2. The Related Art

Fibre channel connectors promote high-speed data transfer between workstations, mainframes, supercomputers, and storage devices. The conventional fibre channel includes a plug connector defining a recess for receiving a PCB having a plurality of contacts mounted thereon. The PCB is assembled to the plug connector from a top face thereof whereby the PCB is snap-fit into the plug connector. Such an assembly method causes free ends of the contacts to free float in the plug connector whereby the contacts will not be protected from inadvertent deformation when engaging with contacts of a mating receptacle connector. Furthermore, the engagement between the PCB and the plug does not properly secure the PCB therein which may adversely affect signal transmission. Hence, an improved fibre channel is requisite to overcome the problems of the prior art.

SUMMARY OF THE INVENTION

Accordingly, an objective of the present invention is to provide a fibre channel connector which slidably receives a PCB with a contact unit mounted thereon in a slot defined in a plug connector whereby tail ends of the contacts are protected from inadvertent deformation.

Another objective of the present invention is to provide a fibre channel connector having a snap lock device whereby a PCB can be securely retained in a plug connector thereof.

An electrical connector in accordance with a preferred embodiment of the present invention comprises a plug, a printed circuit board, and a contact unit mounted on the PCB and comprising a plurality of contacts with an insulative housing formed therearound. The PCB together with the contact unit is slidably received in a slot defined in the plug wherein free ends of lock arms of the plug engage with corresponding locking projections formed on the housing of the contact unit thereby securely retaining the PCB in the plug. A plurality of contact receiving passageways are defined in the plug each having a lip protruding therein from a rear end of the plug. Each lip engages with a tail end of the corresponding contact thereby preventing inadvertent deformation of the contact during assembly with a mating receptacle connector.

These and additional objects, features, and advantages of the present invention will become apparent after reading the following detailed description of the preferred embodiment of the present invention taken in conjunction with the appended drawing figures.

DETAILED DESCRIPTION OF THE PREFERRED EMBODIMENT

References will now be made in detail to the preferred embodiment of the invention.

Figure 1:
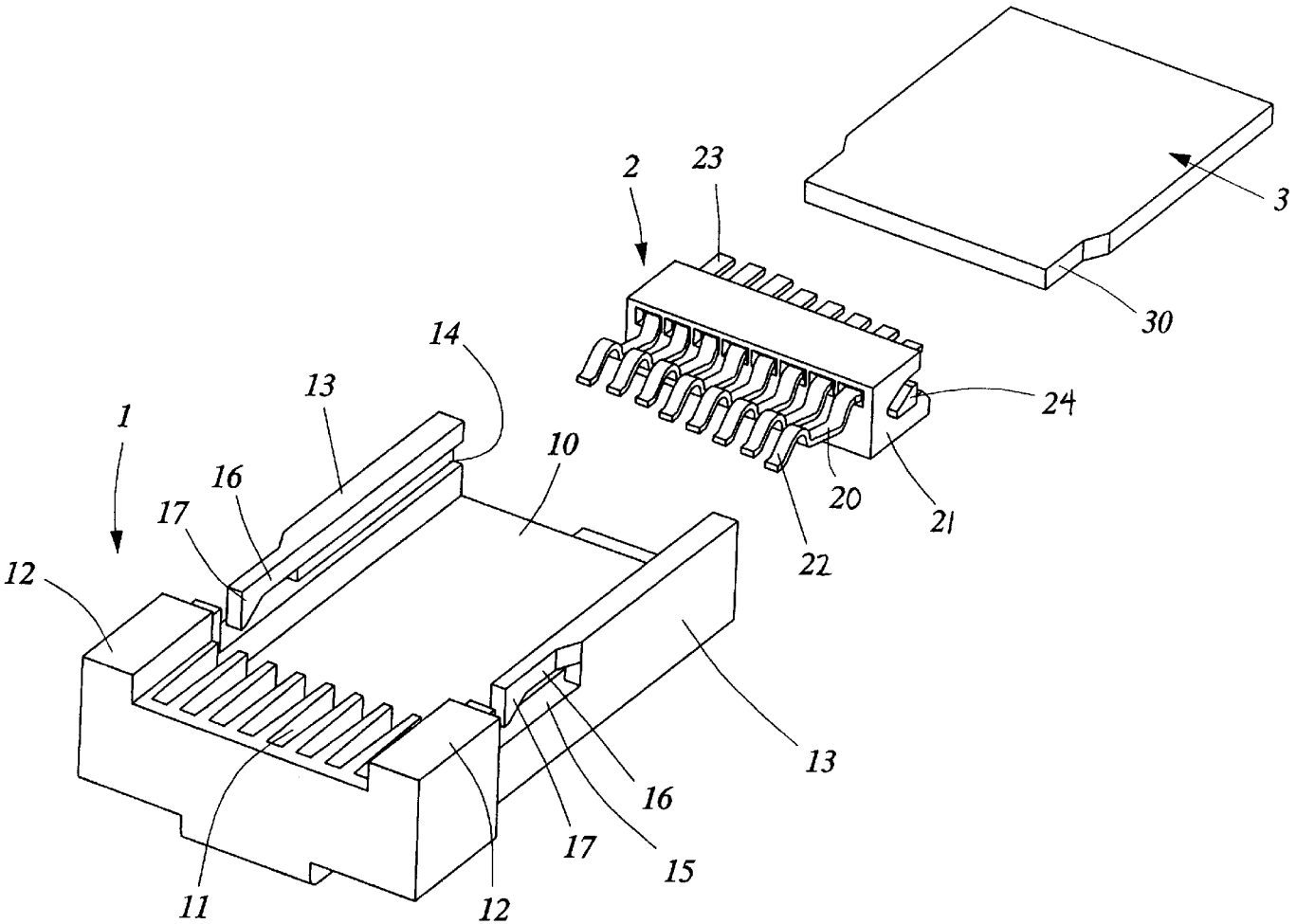
FIG. 1 is an exploded view of the fibre channel connector in accordance with the present invention.

Referring to FIG. 1, an electrical connector in accordance with the present invention comprises a plug 1, a contact unit 2 comprising a plurality of contacts 20 with an insulative housing 21 formed therearound, and a printed circuit board 3.

The plug 1 is made from a dielectric material and defines a recess 10 in a top face thereof. The recess 10 is exposed to a front end of the plug 1. A plurality of passageways 11 are defined in the top face of the plug 1 proximate a rear end thereof between a pair of end blocks 12. The passageways 11 are in communication with the recess 10. Walls 13 extend from opposite sides of the plug 1 proximate the front end thereof. Each wall 13 defines a slot 14 in an inner surface thereof whereby the slots 14 are in communication with the recess 10. An opening 15 is defined in each wall 13 proximate the corresponding end block 12. A resilient lock arm 16 horizontally and rearwardly extends from each wall 13 into the corresponding opening 15. Each lock arm 16 is formed with a downwardly projecting free end 17.

The contacts 20 are aligned in parallel within the housing 21 whereby curved tail ends 22 thereof project rearwardly therefrom and opposite solder ends 23 thereof project forwardly therefrom. A pair of triangular locking projections 24 is formed on opposite distal ends of the housing 21. The solder ends 23 of the contacts 20 are soldered to a rear end of the PCB 3. A pair of cutouts 30 is defined in the PCB 3 in rear corners thereof.

Figure 2:
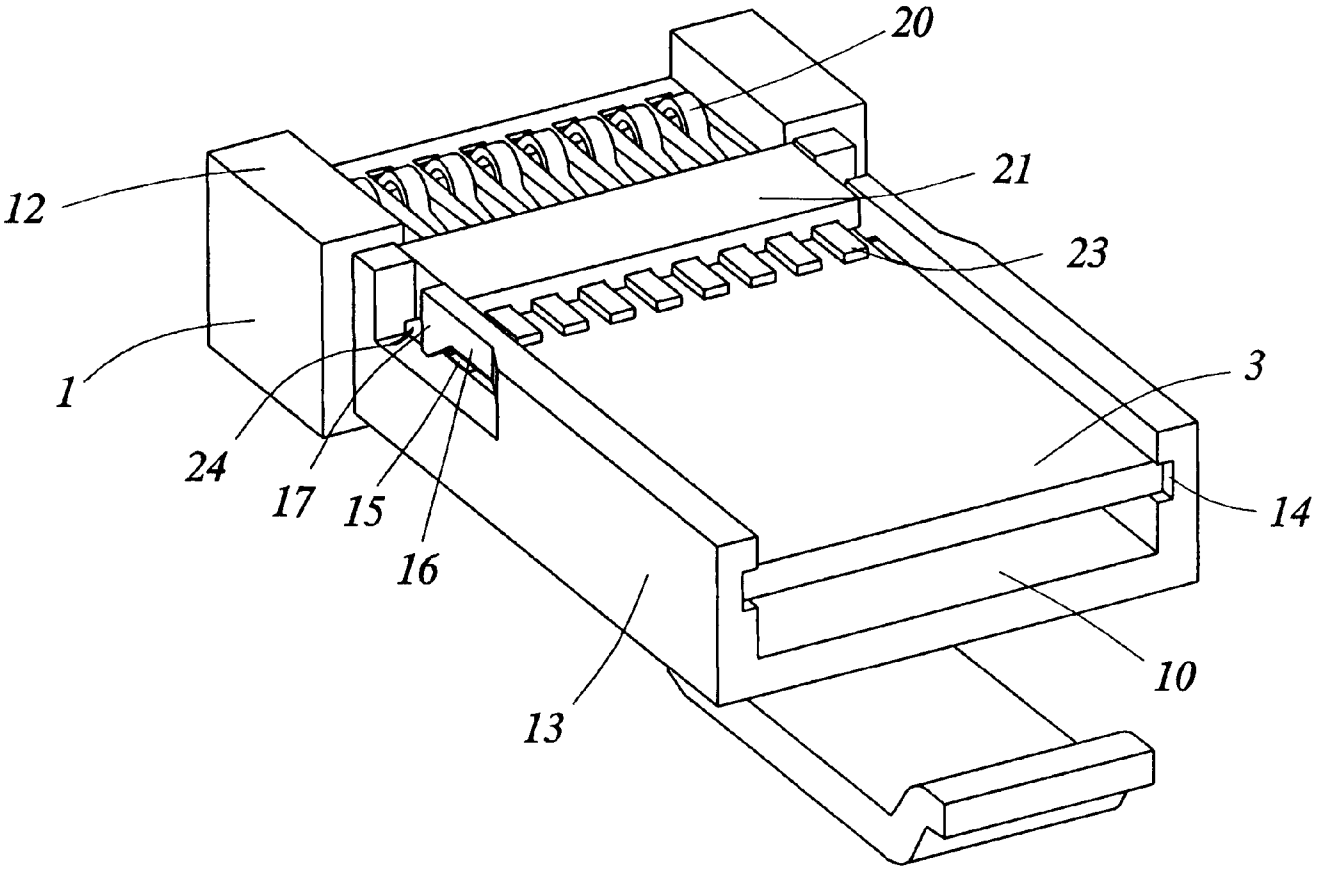
FIG. 2 is an assembled view of FIG. 1.
Figure 3A:
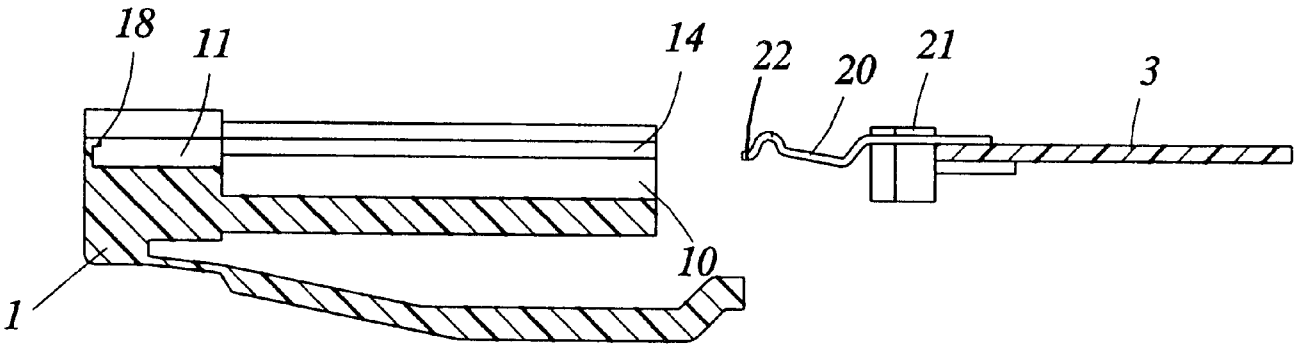
FIGS. 3A and 3B are a cross sectional views showing the method of slidably engaging a PCB having a contact unit mounted thereon with a plug of the fibre channel.
Figure 3B:
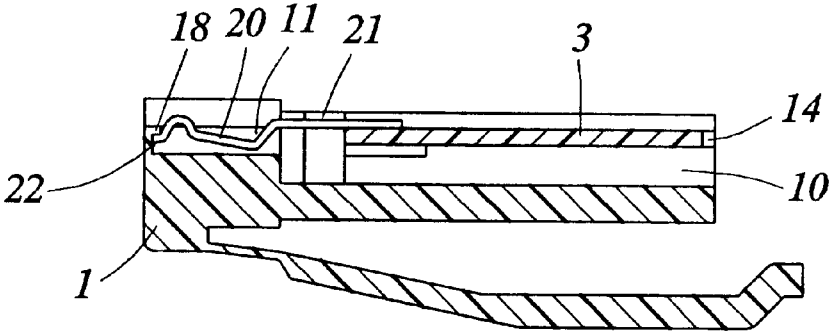

Referring to FIGS. 3A and 3B, the PCB 3 together with the contact unit 2 is slidably received in the slot 14 wherein the free end 17 of each lock arm 16 slides along an inclined surface of the corresponding locking projection 24. The lock arms 16 will deform until the contacts 20 are fully received in the corresponding passageways 11 whereby rear surfaces of the free ends 17 of the lock arms 16 abut against front surfaces of the corresponding locking projections 24, as seen in FIG. 2. The lock arms 16 and the locking projections 24 constitute a snap lock device wherein the engagement therebetween securely retains the PCB 3 in the plug 1. To remove the PCB 3 from the plug 1, the lock arms 16 are manually deformed to disengage with the locking projections 24 and the PCB 3 is slid out of the slot 14.

Each passageway 11 has a lip 18 protruding therein from a rear end of the plug 1. Each lip 18 engages with the tail end 22 of the corresponding contact 20 when the PCB 3 is retained in the plug 1. The provision of the lip 18 prevents inadvertent deformation of the contact 20 during assembly with a mating receptacle connector (not shown).

It can be understood that in the invention the contact unit 2 with the associated printed circuit board 3, is installed into the plug 1 with a slide-in horizontal insertion wherein the printed circuit board 3 can be, during insertion, guidably moved along and, after insertion, fully supportably engaged within the slots 14 in the walls 13, and the tails end 22 of the contacts 20 can confront the corresponding lips 18 for preloading consideration and/or prevention of inadvertent deformation of the contact. In opposite, the prior art plug generally adopts the top loading installation of the contact unit with the print circuit board, wherein no lip for the contacts can be provided on the plug due to the top loading situation, and no proper support is provided for the print circuit board.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

I claim:

1. An electrical connector comprising:

a plug defining a recess and at least a passageway in communication with the recess in a top face thereof and forming walls on opposite sides of the plug, each wall defining a slot in an inner surface thereof, a resilient lock arm extending from each wall into an opening defined therein;

a printed circuit board; and a contact unit comprising at least a contact with an insulative housing formed therearound, the housing forming a pair of locking projections on opposite distal ends thereof, solder ends of the contacts being attached to the printed circuit board and tail ends of the contacts being received in the corresponding passageways;

wherein the printed circuit board together with the contact unit is slidably received in the slot whereby free ends of the lock arms engage with the corresponding locking projections thereby securely retaining the PCB in the plug.

2. The electrical connector as described in claim 1, wherein the free end of each lock arm projects downwardly.

3. The electrical connector as described in claim 1, wherein the locking projections are triangular.

4. The electrical connector as described in claim 1, wherein rear surfaces of the free ends of the lock arms abut against front surfaces of the corresponding locking projections.

5. The electrical connector as described in claim 1, wherein the recess is exposed to a front end of the plug.

6. The electrical connector as described in claim 1, wherein the passageways are defined proximate a rear end of the plug.

7. The electrical connector as described in claim 1, wherein the walls extend from the plug proximate a front end thereof.

8. The electrical connector as described in claim 1, wherein the openings are defined in each wall proximate a rear end of the plug.

9. The electrical connector as described in claim 1, wherein the lock arm horizontally and rearwardly extends from each wall into the corresponding opening.

10. The electrical connector as described in claim 1, wherein a pair of cutouts is defined in rear corners of the printed circuit board.

11. An electrical connector comprising:

a plug defining a recess and at least a passageway in communication with the recess in a top face thereof, and forming walls on opposite sides of the plug and a lip protruding into each passageway, each wall defining a slot in an inner surface thereof;

a printed circuit board; and a contact unit comprising a plurality of contacts with an insulative housing formed therearound, solder ends of the contacts being attached to the printed circuit board and tail ends of the contacts being received in the corresponding passageways;

wherein the printed circuit board together with the contact unit is slidably received in the slot and securely retained in the plug and each lip engages with the tail end of the corresponding contact thereby preventing inadvertent deformation of the contact during assembly with a mating receptacle connector.

12. The electrical connector as described in claim 11, wherein each lip protrudes into the corresponding passageway from a rear end of the plug.

13. An electrical connector comprising:

a plug defining a recess and at least a passageway in communication with the recess and forming walls on opposite sides of the plug;

a contact unit with an associated printed circuit board received within the recess; and means provided on the walls for guiding insertion of the contact unit and the associated printed circuit board into the plug, and also for fully supporting the printed circuit board in the plug after insertion of the printed circuit board into the plug, the means including a slot which extends horizontally along an inner surface of each of said walls and is dimensioned to properly receive a corresponding locking projection of the contact unit.

14. The connector as described in claim 13, wherein said slot is dimensioned to properly receive the printed circuit board.

15. The connector as described in claim 13, wherein the plug includes a resilient lock arm around each slot for engagement with the locking projection.

* * * * *